US007281881B1

(12) United States Patent
Cermelli et al.

(10) Patent No.: US 7,281,881 B1
(45) **Date of Patent: *Oct. 16, 2007**

(54) COLUMN-STABILIZED PLATFORM WITH WATER-ENTRAPMENT PLATE

(75) Inventors: Christian Cermelli, San Francisco, CA (US); Dominique Roddier, Berkeley, CA (US); Catherine Busso, Strasbourg (FR); Alexia Aubault, San Francisco, CA (US)

(73) Assignee: Marine Innovation & Technology, Berkeley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/483,428

(22) Filed: Jul. 10, 2006

Related U.S. Application Data

(63) Continuation-in-part of application No. 10/348,135, filed on Jan. 21, 2003, now Pat. No. 7,086,809.

(51) Int. Cl.
*B63B 35/44* (2006.01)

(52) U.S. Cl. ..... 405/203; 405/224; 114/264

(58) Field of Classification Search ..... 405/203, 405/224; 114/264
See application file for complete search history.

(56) References Cited

U.S. PATENT DOCUMENTS

| | | | | |
|---|---|---|---|---|
| 3,397,545 | A * | 8/1968 | Leavitt | 405/208 |
| 3,708,991 | A * | 1/1973 | Barkley | 405/194 |
| 3,986,471 | A * | 10/1976 | Haselton | 114/265 |
| 7,086,809 | B2 * | 8/2006 | Busso | 405/203 |

* cited by examiner

*Primary Examiner*—Sunil Singh

(57) ABSTRACT

An apparatus for use in offshore oil or gas production in which a plurality of vertical stabilizing columns are supported on a submerged horizontal water entrapment plate is provided to support minimum offshore oil and gas production facilities above a subsea wellhead, or subsea processing facilities, or a submarine pipeline, and whose main function is to provide power or chemicals or to perform other operations such as compression, injection, or separation of water, oil and gas. The apparatus is maintained in the desired location by a plurality of mooring lines anchored to the sea-bed. The respective size and shape of the columns and water entrapment plate are designed to provide sufficient buoyancy to carry the weight of all equipment on the minimum floating platform and mooring lines, umbilical and risers attached to it, and to minimize the platform motion during normal operations.

3 Claims, 7 Drawing Sheets

COLUMN-STABILIZED PLATFORM WITH WATER-ENTRAPMENT PLATE

This application is a Continuation-In-Part of patent application Ser. No. 10/348,135 filed Jan. 21, 2003 now U.S. Pat. No. 7,086,809.

BACKGROUND OF THE INVENTION

The present invention relates to a floating apparatus for supporting an offshore platform. The apparatus of the invention includes a plurality of vertical columns attached to a submerged horizontal water entrapment plate on their lower end, and to a deck which supports minimum offshore facilities for the production of hydrocarbons offshore on their upper end. In another aspect, the present invention relates to methods for supporting minimum facilities required for the production of offshore hydrocarbon reservoirs from marginal fields.

With increasing exploration activities from offshore basins, such as the Gulf of Mexico, numerous discoveries of relatively small hydrocarbon accumulations have taken place. Many of these fields do not contain sufficiently large amount of oil or gas to justify the expenses of a stand-alone field development, such as a production platform and pipeline infrastructure. In many instances, however, these fields can be produced using subsea-tiebacks to existing infrastructure. These include a subsea wellhead and a flowline to an existing production platform for example.

Serious limitations are expected with longer subsea tie-back, such as plugging of the line due to a decrease in pressure and temperature along the flowline. Conventional remedial measures include injection of chemicals to prevent formation of hydrates. Such chemicals can be transported from the host platform to the subsea wellhead in an umbilical, and can be injected into the flowline at the wellhead. The umbilical can also be used to control the subsea wellhead. The cost of such umbilical is typically very large, and economics of a subsea tie-back is often threatened by the excessive umbilical cost for tie-back distances greater than 20 miles. An alternative development scenario consists of providing a minimum offshore platform near the wellhead with remote control from the host platform and injection of chemicals stored on the minimum offshore platform via a short umbilical connected to the subsea wellhead.

In some cases, where multiphase hydrocarbon flow is expected, the tie-back distance is further limited because of flow assurance issues. Current technological developments are aimed at providing subsea separation facilities to allow hydrocarbons to flow over a greater distance. Such subsea facilities may require additional surface facilities such as power generation and complex control capability.

Similarly, equipment such as subsea pumps may be required to assist flow assurance over the tie-back length. Such pump requires power which can be provided by a surface facility located above the pump.

Other technological solutions provided to the flow assurance problem for extended tie-back include electrically heated flowline, which may be heated either continuously or before start-up. The power required to heat the flowline may be produced by a generator located on minimum offshore facilities floating above the flowline.

Current technologies allow certain processing operations to be performed using much smaller equipment than traditional technologies. A minimum offshore platform could therefore be used to perform operations currently conducted on much larger platforms. This could further extend the distance over which hydrocarbon can be transported allowing them in cases to reach the shore directly for further processing.

A minimum offshore platform can also be used to perform basic maintenance workover on the wellhead. This saves the high cost of mobilization of a vessel suitable for typical workover operation.

Therefore, there is a need for minimum offshore platform in order to reduce the cost of development of marginal fields so as to make them profitable.

Different types of offshore platforms can be considered for production of hydrocarbons in deepwater. For example, Tension Leg Platforms (TLP's) are anchored to the seabed using vertical steel pipes, called tendons, which provide a large stiffness in the vertical direction. Mini-TLP's are smaller versions of TLP, but are typically not stable before they are connected to their tethers, and therefore the installation process is very complex, often requiring installation of Temporary Stability Modules as disclosed by Huang, U.S. Pat. No. 7,033,115, or installation of the deck and topsides offshore after the hull has been connected to its tethers. In very deep waters, much of the platform buoyancy is used to support the weight of the tendons, which reduces the payload-over-displacement ratio of these platforms.

Other existing floating platform concepts include deep draft caissons or spars, which are typically mono-column systems with a draft in excess of 400 ft. The draft is such that wave exciting forces are considerably reduced at the keel of the caisson. Because of the large size of the caisson, also referred to as "hard tank", the amount of steel required to fabricate the platform is very large. A lighter version was proposed by Horton U.S. Pat. No. 5,558,467, wherein several horizontal water-entrapment plates were provided at a depth below which wave action does not contribute to heave motion. Topsides on these platforms must normally be installed offshore using heavy lift vessels.

Semi-submersible platforms, also referred to as column-stabilized platforms were initially designed to perform drilling activities offshore. These are composed of a plurality of vertical columns spaced a significant distance apart in order to provide stability. These platforms have also been used to support production facilities in deep- and ultradeep-water. Their displacement is in excess of 20,000 tons to achieve motion characteristics suitable for activities involved with the production of hydrocarbons offshore, such as support of risers, which are pipes carrying hydrocarbons or other fluids between the seabed and the process equipment located on the platform deck. These platforms can therefore carry a large payload, in excess of several thousands tons, but consequently their cost is high, and because of their large size, the required mooring system is also very large and costly.

Floating Production Storage and Offloading (FPSO) units constitute another type of floating platforms, which are ship-shaped, typically crude-oil carriers converted into production platforms. These are very large units. One of their advantages is the ability to store crude onboard the platform, and to offload to trading tankers.

All platforms described above must be very large to support production equipment in deep- or ultradeep-waters. Because wave loading increases with the size of the platform, the mooring or tendon system necessary to maintain these platforms on location is typically very large and costly. Thus, in spite of advancements in the art, there still exists a need for a low cost offshore platform to support relatively small payloads for the development of marginal offshore fields, which do not suffer from the disadvantages of the prior art apparatuses.

In order to develop smaller size or marginal fields, the weight of required process equipment is reduced, however existing platform concept cannot be easily scaled down because their motion performance tends to degrade considerably with smaller sizes. The platform of the present invention provides an alternative to existing platform concepts, which can be scaled down to the minimum required to support payload for small size hydrocarbon fields while retaining sufficient stability characteristics.

Column-stabilized platforms offer significant advantages over other platform types. Their motion characteristics are good compared with ship-shaped floaters. They can also be fully integrated at quayside, since their draft with topsides installed, is normally not very large, and they can be easily towed to their installation site.

The dynamics of offshore platforms can often be modeled using the relatively simple concept of harmonic oscillators, wherein the harmonic exciting force is provided by the oscillating wave force, the mass of the system is comprised of the platform mass as well as its added-mass, which is the amount of water entrained with the platform, the stiffness comes from hydrostatic effects, or changes in buoyancy with the motion of the platform, and damping comes from radiated waves or viscous effects. The Response Amplitude Operators (RAO) are mathematical expressions of the platform motion in its six-degrees of freedom—surge, sway, heave, pitch, roll and yaw—for incident waves of unit amplitude. The RAO go through a maximum when the platform natural periods, or resonant periods, coincide with the wave period. Designers aim at keeping the platform natural periods away from the most energetic wave frequency bands.

The size and spacing of columns of a semi-submersible platform is adjusted to provide the stability necessary to resist storm wind overturning moments, or destabilizing effects resulting from flooding of one of the columns. These dimensions are also adjusted to tune the platform dynamic response to the wave environment. In most offshore locations, wave periods vary between approximately 4 to 18 seconds. Typically the heave, pitch and roll natural periods are in excess of 20 seconds, so that dynamic amplification of the wave response only occurs for frequency bands where there is little wave energy. In certain areas, where very long period waves are found, it may be difficult to shift the heave natural period completely out of the wave energy range. Additional source of damping, such as disclosed by Leavitt (U.S. Pat. No. 3,397,545) can be provided to reduce the amplitude of the resonant response.

The heave natural period of a semi-submersible depends on the mass of the platform, its heave added-mass, and the column cross-sectional area. Similarly, pitch and roll natural periods depend on the platform inertia, its added-moment of inertia, which is the rotational equivalent of added-mass, and the platform metacentric height, GM. GM depends on the height of the center of mass, the center of buoyancy and the inertia of the waterplane area, which is related to the spacing of the columns and their size. The surge, sway and yaw properties of the platform can be adjusted with the mooring system.

As semi-submersible platform payload requirements are reduced and the platform get smaller, in order to keep the natural period in heave away from the wave spectrum, the column cross-sectional area may be reduced, which results in a reduction in the vertical stiffness, however this also results in a reduction of static stability. In order to compensate for the loss of static stability, the distance between columns can be increased, however the structural beams on the deck must be made stronger to support the increased span, resulting in significant weight increase of the platform deck. This undesirable "design spiral" is avoided by the present invention.

SUMMARY OF THE INVENTION

It is an object of the present invention to provide an apparatus and a method for developing marginal fields. It is another object of the present invention to provide an apparatus and a method for developing marginal fields which do not suffer from the drawbacks of the prior art apparatuses and methods.

According to one embodiment of the present invention, there is provided an offshore platform comprising a buoyant substructure, a deck supporting minimum offshore facilities, mooring lines connecting the platform to the seafloor, and an umbilical between the platform and subsea facilities located approximately beneath the platform on the seafloor.

The substructure of the present invention is comprised of plurality of vertical buoyant columns attached to a horizontal water entrapment plate at their lower end and to a deck that supports offshore facilities at their upper end. The horizontal plate extends radially from each column and covers the area formed by the center of the columns base. Offshore facilities include but are not restricted to any combination of the following equipment: a power generator to provide electricity to subsea facilities located beneath the platform on the seafloor, hydraulic motors to provide hydraulic power to a subsea wellhead or manifold, antennas and other communication equipment to exchange information with a host platform, a helideck, chemical storage and distribution systems, overnight accommodations for maintenance personnel, a crane or gantry to move equipment on the deck, a winch and A frame to perform workover on the wellhead, pumps or compressors to boost pressure in the tie-back flowline.

The platform of the present invention is a column-stabilized unit with a large water-entrapment plate attached at the base of the columns. The submerged horizontal water entrapment plate is designed to provide increased resistance to vertical accelerations and to roll and pitch rotational accelerations. This plate is referred to herein as "water entrapment plate" because large amounts of water are displaced as the plate tends to move vertically. The mass of this displaced water, also referred to as "added-mass" is of the same order or larger than the mass of the platform. The total area of the plate is several times the cross-sectional area of the columns.

The plate size and shape is adjusted so that the natural heave, pitch and roll period of the platform significantly exceeds the wave period of operational sea-states. This ensures that the platform motion remains small during normal operation. The plate extends radially from each column forming a section of a polygon. The radial distance can be adjusted to control the natural roll and pitch period. The overall plate area is adjusted to control the heave natural period.

In the section of the water-entrapment plate extending outward of the columns, no support to other parts of the hull is available near the plate outer edge, and therefore the water-entrapment plate must be cantilevered from the column. Because of the large hydrodynamic loads sustained by the water-entrapment plate, large structural supports are required to ensure the integrity of the plate and of its connection to the column.

DETAILED DESCRIPTION OF THE INVENTION

Figure 1:
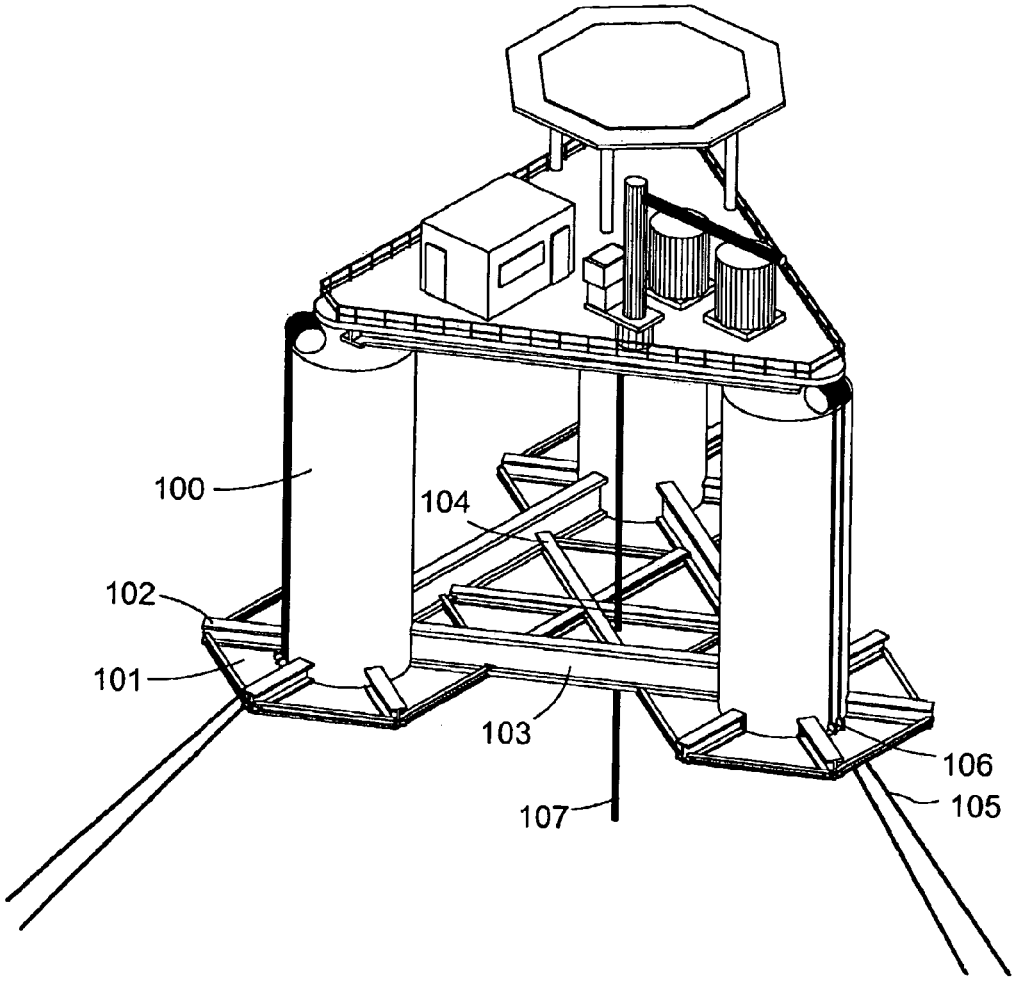
FIG. 1 is a perspective view of a preferred embodiment of the present invention in a three-columns configuration.
Figure 2:
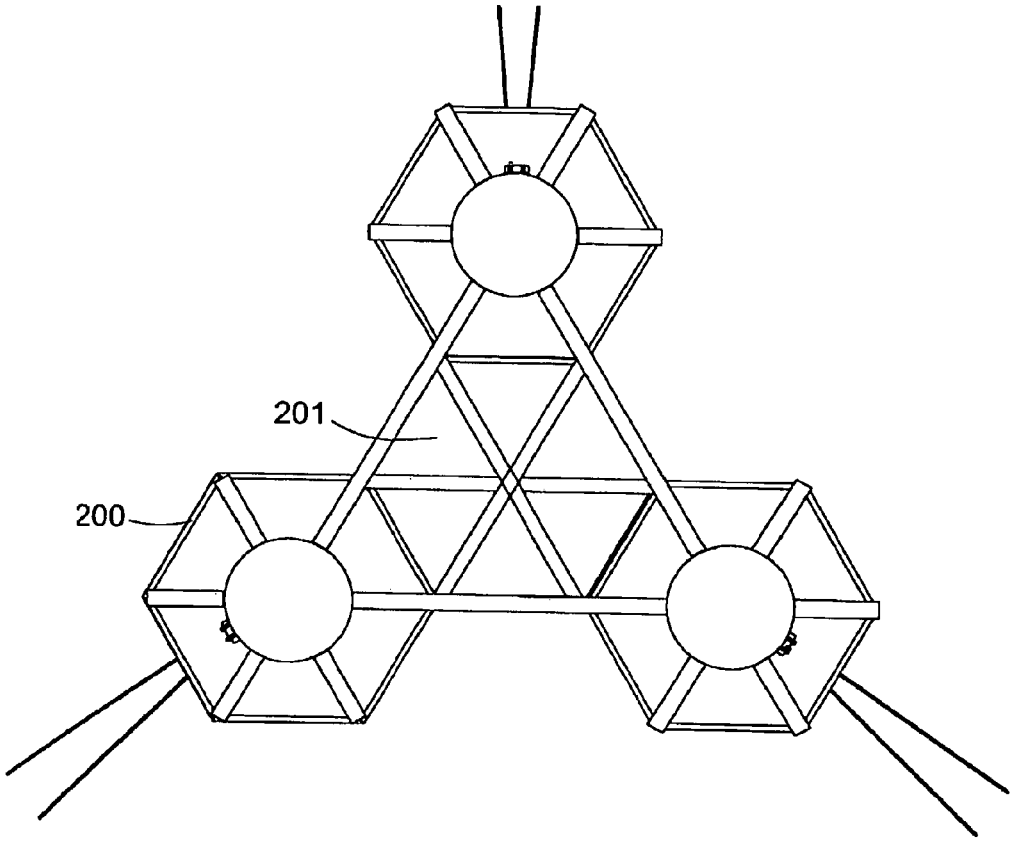
FIG. 2 is a plane view of the substructure of the present invention in a three-columns configuration.
Figure 3:
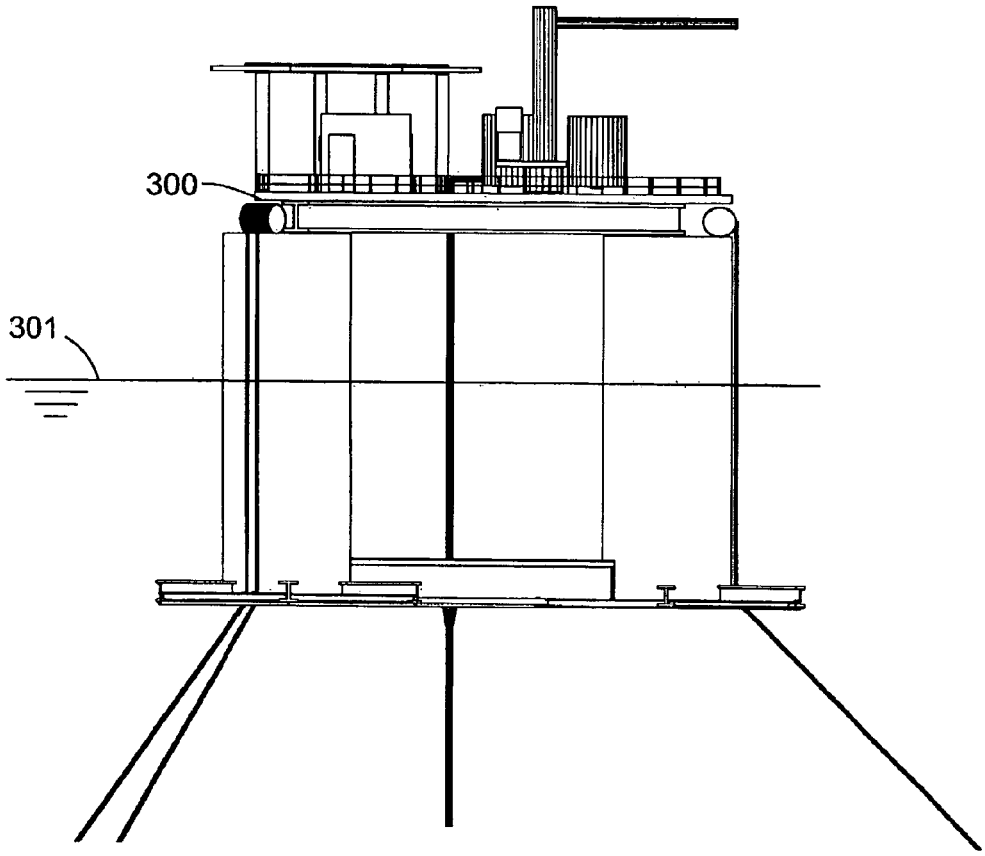
FIG. 3 is an outboard profile of the present invention in a three-columns configuration.
Figure 4:
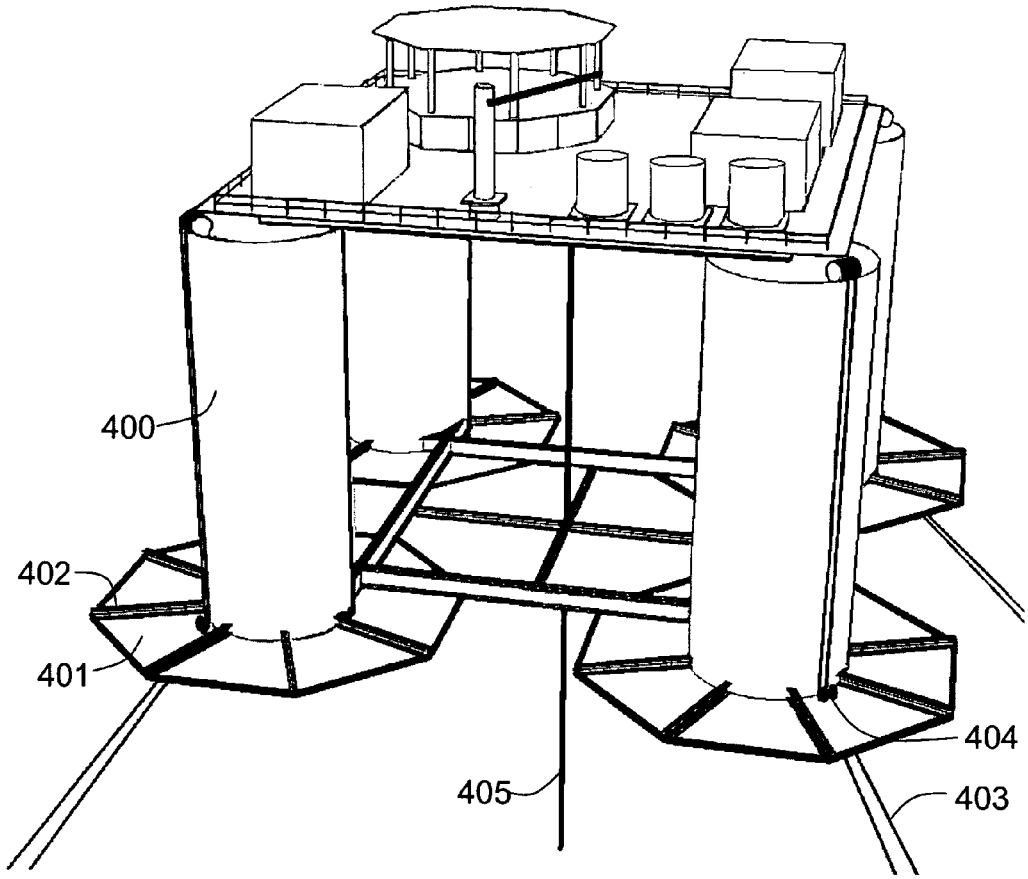
FIG. 4 is a perspective view of a preferred embodiment of the present invention in a four-columns configuration.
Figure 5:
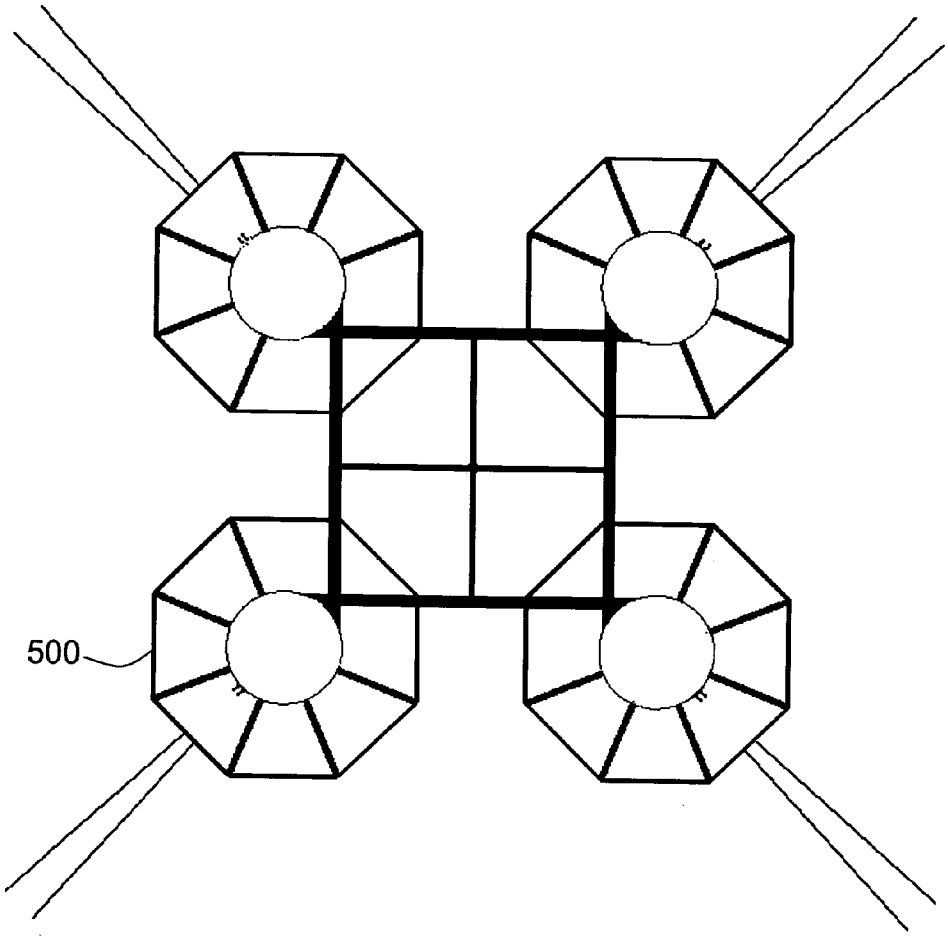
FIG. 5 is a plane view of the substructure of the present invention in a four-columns configuration.
Figure 6:
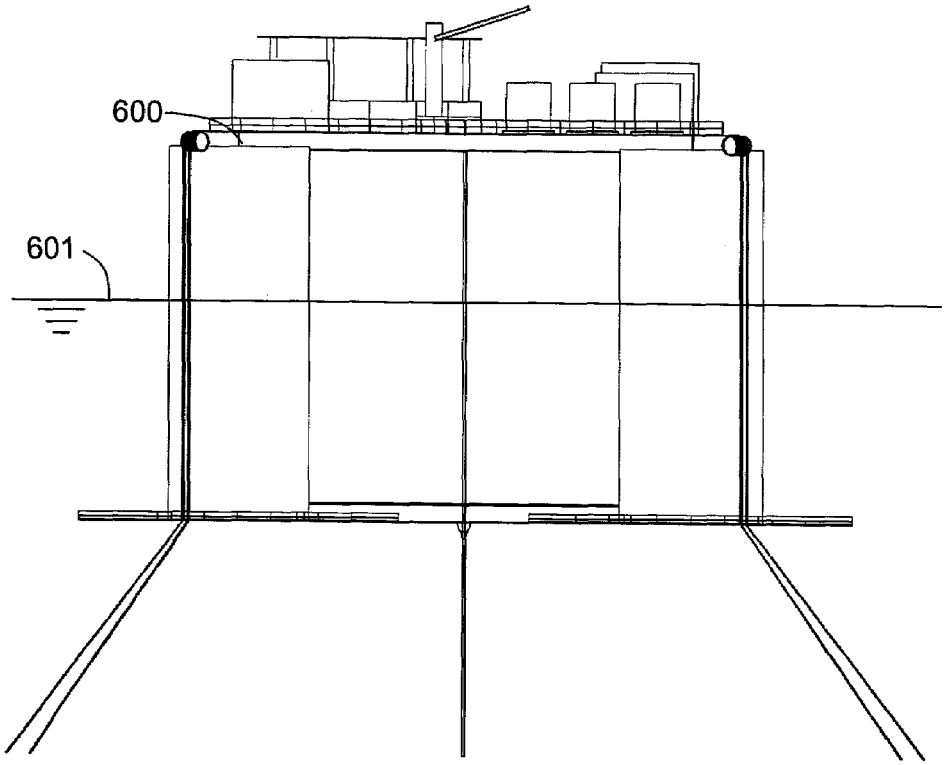
FIG. 6 is an outboard profile of the present invention in a four-columns configuration.

The platform is composed of a plurality of vertical stabilizing columns 100, from the base of which an horizontal water-entrapment plate 101 extends, supported by radial stiffeners 102. The water entrapment plate may be located at the base of the columns or somewhat higher to ease construction and operation of the apparatus. Large beams 103 are connected to the columns at both ends providing rigidity to the platform. Stiffeners or girders 104 provide additional support to the water-entrapment plate. The platform is anchored to the seabed with mooring lines 105. Fairleads are located at the base of the column 106 and allow passage of the mooring lines through openings in the water-entrapment plate. Risers or umbilicals 107 are supported by the platform to perform hydrocarbon production activities. The platform deck 300 is located a sufficient distance above the mean water line 301 to prevent contact of the wave crests onto the deck main structural supports during the most severe storms.

The present apparatus can easily be assembled in a dry-dock or fabrication yard using prefabricated elements such as beams, plates, and columns, and it can then be fitted with its equipment. After completion and pre-commissioning, it can be floated out to sea and towed to its installation site where the mooring system has been pre-installed. The mooring lines are then connected to a section of chain located on the apparatus and pre-tensioned to a specified tension value. Umbilical or risers are then pulled-in using a winch located on the present apparatus and connected with the required pretension.

The function of the water entrapment plate 101 is to provide hydrodynamic added-mass and damping. The amount of water "entrained" by a square plate with side length $\lambda$ moving along its normal direction is approximately equal to $\rho\lambda^3$ where $\rho$ is the water density. A large amount of entrained water also known as hydrodynamic added-mass is therefore associated with a square horizontal plate of substantial dimensions moving vertically. A rectangular plate with a large aspect ratio will entrain much less water relatively to its area.

The shape of the water-entrapment plate is sufficiently large to cause a substantial increase of the platform added-mass in heave and added-moment of inertia in roll and pitch. Since the platform draft is relatively shallow, typically 100 feet or less, wave exciting forces on the water-entrapment plate cannot be neglected. Hydrodynamic calculations were conducted to determine the response of the platform taking into account the increase in added-mass and wave exciting forces. A well-established commercial diffraction-radiation software, WAMIT, was used to compute the platform responses. A 15,000 tons displacement platform carrying over 7,000 tons payload was considered for these computations. Without water-entrapment plate, the platform natural period is around 12 seconds, which corresponds to a frequency band with considerable amount of energy during hurricane events. The resulting resonant response yields unacceptable platform motion, resulting in damage to the risers and wave impact on the deck. By adding the water-entrapment plate, which extends 20 to 30 feet from the column base, the platform heave natural period can be extended to 20 seconds, which results in acceptable motion response. The Response Amplitude Operators are equivalent to a conventional semi-submersible that is four times larger than the minimal platform fitted with a water-entrapment plate.

In summary, if the water-entrapment plate is properly designed by adjusting the radial distance from the column center, and the total plate area, it can provide a substantial increase in vertical added-mass, while minimizing the increase in wave exciting force, resulting in a beneficial effect on platform motion. Furthermore, this stabilizing effect is especially beneficial for small platforms for which suitable performance cannot be obtained merely by adjusting column size and spacing.

Figure 7:
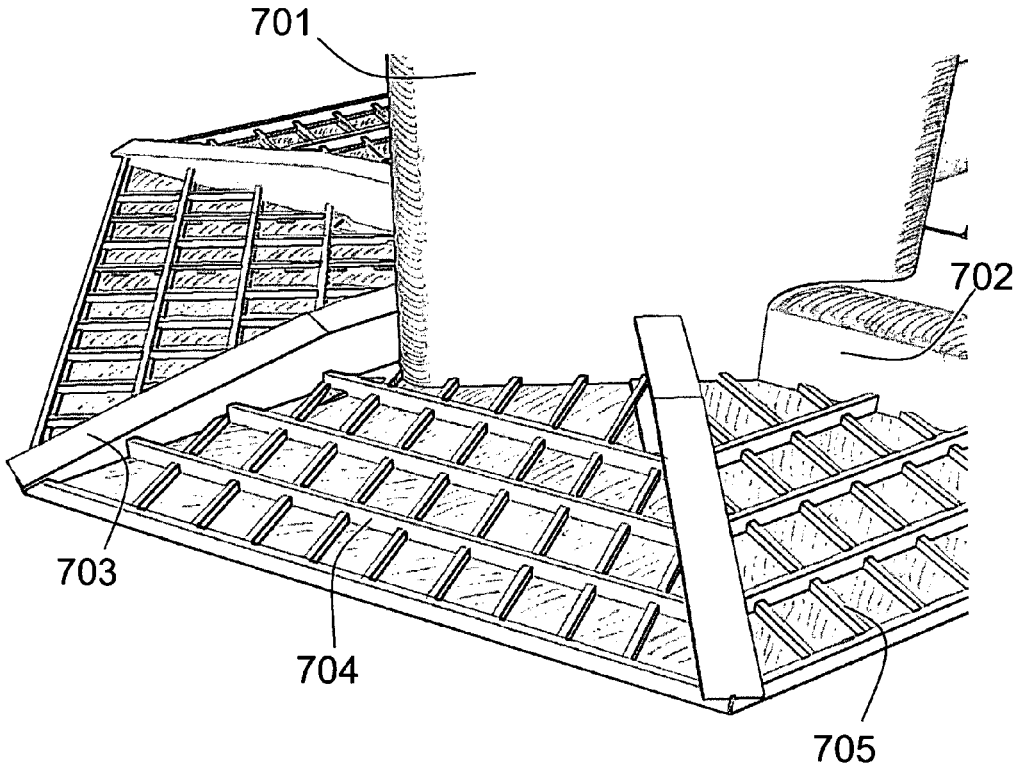
FIG. 7 is perspective view of structural details of the water-entrapment plate.

Due to its size, the water-entrapment plate attracts large hydrodynamic loading including added-mass and wave radiation effects, wave exciting forces and viscous effects due to shedding of vortices from the edges of the plate. The plate must be supported by structural members in order to withstand extreme wave loading as well as fatigue damage due to the large number of wave cycles it is subjected to. Large radial stiffeners 702, extending from the columns 701 toward the plate outer edges are required to support the plate. Large beams 702 connecting two columns also provide support to the water entrapment plate, as well as rigidity to the overall structure. These beams may also provide buoyancy, such as semi-submersible platform pontoons, in order to reduce the draft of the platform when it is towed to its installation site. A stiffened plate configuration is described in FIG. 7 with girders 704 supported by the radial stiffeners 702, and stringers 705 supported by the girders 404. These structural members support the steel panels forming the water-entrapment plate.

In order to properly dimension the water-entrapment plate stiffeners, the various hydrodynamic effects taking place on the plate must be properly accounted for; these consist of the following: inertia of the fluid surrounding the water-entrapment plate cause a force opposing the acceleration of the platform, particularly in the vertical direction; radiated waves generated by the platform as it moves result in energy being removed from the platform, incident waves interact with the platform hull causing forces, and viscous effects, predominantly due to the shedding of vortices from the plate edges also result in transfer of energy from the platform to the fluid. All forces except the viscous forces were modeled based on the diffraction-radiation theory which neglects the fluid viscosity, and require numerical solution of the Laplace equation. Viscous effects were determined from an empirical model developed with small-scale laboratory experiment results. The hydrodynamic forces were converted to a pressure field on the platform submerged portion, including the water-entrapment plate, and a structural finite-element model was then run to determine stresses in all structural members including stiffeners and plating. The finite-element model requires discretization of the hull into small elements on which the beam or plate theory is applied. A numerical solution can be obtained providing stress levels on the hull. Proper sizing of the hull, including the water-entrapment plate was then confirmed.

Columns 701 are typically cylindrical structures which may have circular, square or rectangular cross-section. The edges of square or rectangular columns may be rounded to reduce stress concentration and reduce the drag loads. Columns are made of stiffened plates with water-tight horizontal or vertical walls forming separate compartments. This allows the platform to remain afloat even if one of the columns is punctured. An access shaft may be created near the center of the columns to provide continuous access to the lower parts of the structure.

While the illustrative embodiments of the invention have been described with specific details, it is understood that various modifications can be readily made by those skilled in the art without departing from the spirit and scope of the invention. Accordingly, the scope of the claims appended hereto is not limited to the description provided herein but encompasses all the patentable features of the present invention, including all features which would be treated as equivalents thereof by those skilled in the art to which this invention pertains.

We claim:

1. A column-stabilized offshore platform with its center of gravity located above its center of buoyancy comprising:

a plurality of vertical columns;

a submerged substantially horizontal water entrapment plate attached to the lower end of each said columns extending outwardly such as to form a section of circle or polygon around the base of each column;

said water entrapment plate area exceeds the cross-sectional area of the stabilizing column upon which it is attached;

said water entrapment plate is supported by a plurality of radial beams each connected at one end to the base of said columns, and at the other end to the edges of said water entrapment plate, and transverse beams each connected at its both ends to the base of said columns and providing continuous support to said water entrapment plate;

a deck attached to the upper ends of said columns for supporting hydrocarbon production equipment.

2. The offshore platform of claim 1, further comprising three columns disposed about a vertical axis to form a triangle.

3. The offshore platform of claim 1, further comprising four columns disposed about a vertical axis to form a quadrilateral.

* * * * *